US007627133B2

(12) United States Patent
Funahashi

(10) Patent No.: US 7,627,133 B2
(45) Date of Patent: Dec. 1, 2009

(54) DIAPHRAGM AND LOUDSPEAKER USING SAME

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 373 days.

(21) Appl. No.: 10/585,848

(22) PCT Filed: Nov. 18, 2005

(86) PCT No.: PCT/JP2005/021225

§ 371 (c)(1),
(2), (4) Date: Jul. 12, 2006

(87) PCT Pub. No.: WO2006/054687

PCT Pub. Date: May 26, 2006

(65) Prior Publication Data

US 2008/0226116 A1 Sep. 18, 2008

(30) Foreign Application Priority Data

Nov. 22, 2004 (JP) ..... 2004-337115

(51) Int. Cl.
*H04R 25/00* (2006.01)

(52) U.S. Cl. ..... 381/423; 381/398; 381/432

(58) Field of Classification Search ..... 381/398, 381/423, 424, 432; 181/157, 163, 164, 171, 181/172, 173
See application file for complete search history.

(56) References Cited

U.S. PATENT DOCUMENTS

| | | | | |
|---|---|---|---|---|
| 3,180,945 | A * | 4/1965 | Tatsuo Suzuki | 381/432 |
| 6,134,337 | A * | 10/2000 | Isaka | 381/423 |
| 2003/0185415 | A1 * | 10/2003 | Funahashi et al. | 381/398 |

FOREIGN PATENT DOCUMENTS

| | | |
|---|---|---|
| JP | 36-18103 | 7/1961 |
| JP | 45-2459 | 1/1970 |
| JP | 47-41471 | 12/1972 |
| JP | 50-10231 | 2/1975 |
| JP | 61-121687 | 6/1986 |
| JP | 63-236499 | 10/1988 |
| JP | 7-162992 | 6/1995 |
| JP | 9-284886 | 10/1997 |
| JP | 2004-04832 | 2/2004 |

* cited by examiner

*Primary Examiner*—Huyen D Le
(74) *Attorney, Agent, or Firm*—Wenderoth, Lind & Ponack L.L.P.

(57) ABSTRACT

A diaphragm has a through-hole for fixing a voice coil at its center part, and has a fixing part of an edge at its outer periphery which is substantially circular. The shape of the outer periphery of diaphragm is formed as follows: a first circle and a second circle overlap each other with their center points displaced in such a manner that at least one part of an outer periphery of the first circle and the second circle forms a part of the substantially circular outer periphery of the entire shape. Using this structure, signal reproduction characteristics can significantly be flattened by reducing the resonance level.

9 Claims, 4 Drawing Sheets

DIAPHRAGM AND LOUDSPEAKER USING SAME

TECHNICAL FIELD

The present invention relates to a diaphragm and a loudspeaker using the same.

BACKGROUND OF THE INVENTION

Each loudspeaker generates natural resonance vibration frequency. Therefore, the reproduction level fluctuates extraordinarily at the resonance vibration frequency compared with other frequencies, so that it is difficult to flatten reproduction frequency characteristics. As a result, a signal can not be reproduced appropriately.

To solve this problem, Unexamined Japanese Patent Publication No. H7-162992, discloses that the resonance level of a diaphragm at the natural vibration frequency can be suppressed by making the outer periphery of the diaphragm an oval.

As in the example discussed above, making the outer periphery of the diaphragm an oval figure, for example, has a certain effect of suppressing the resonance level at the natural vibration frequency. However, the high resonance level at the natural vibration frequency remains a problem.

SUMMARY OF THE INVENTION

One embodiment of the present invention relates to a diaphragm for a loudspeaker that has a shape overlapping a first circle and a second circle in a top view of the outer periphery shape of the diaphragm, Where in the first circle has a first center point and a first radius, and the second circle has a second center point different from the first center point and a second radius different from the first radius. By forming this shape, signal reproduction characteristics can be significantly flattened.

REFERENCE MARKS IN THE DRAWINGS

Figure 1:
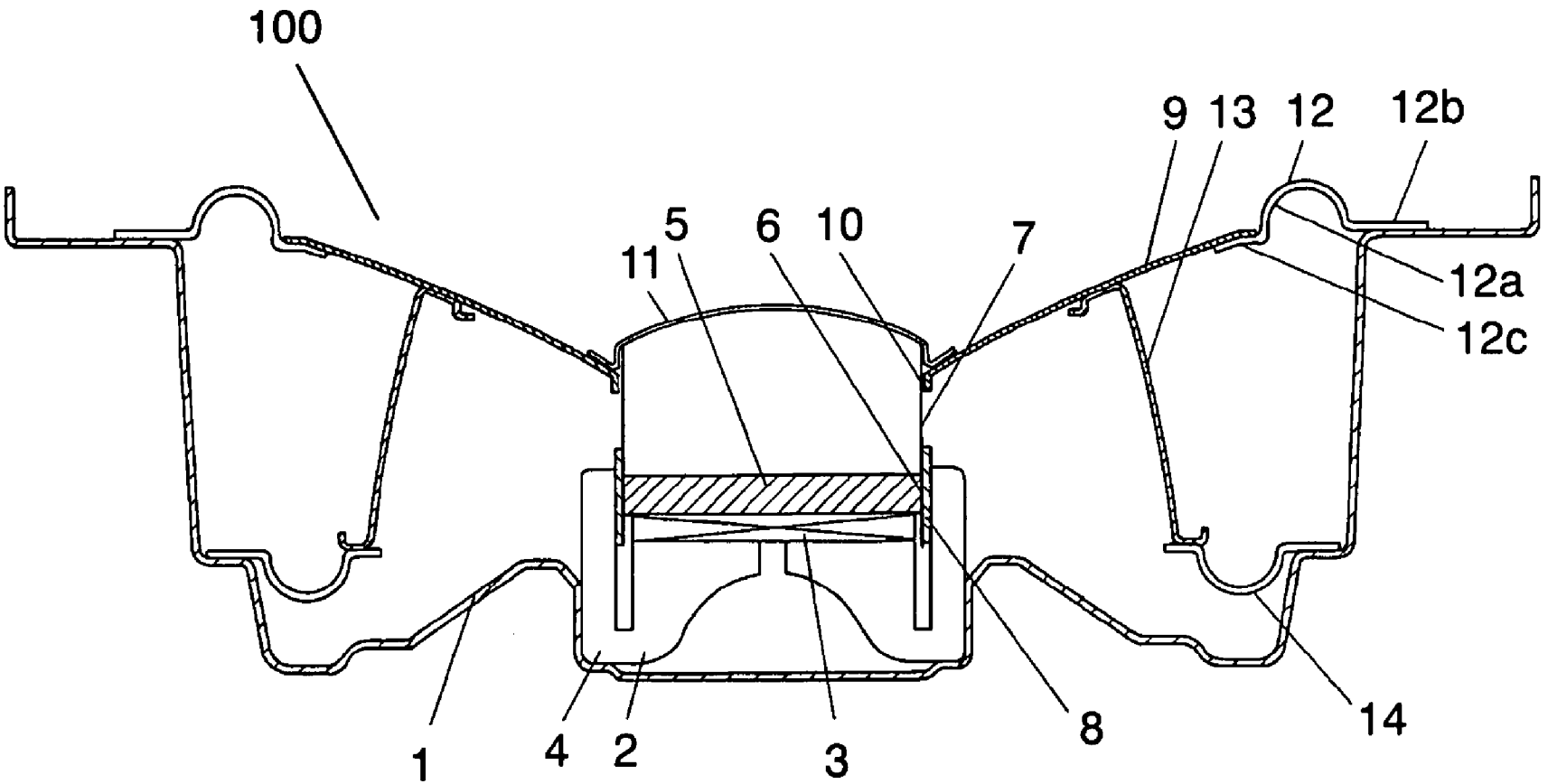
FIG. 1 is a sectional view of a loudspeaker in accordance with an exemplary embodiment of the present invention.

1 frame
2 magnetic circuit
3 magnet
4 yoke
5 plate
6 magnetic gap
7 voice coil
9 diaphragm
9A first circle
9B second circle
9C third circle
9*a*, 9*b*, 9*c* center point
10 through-hole
12, 14 edge

12*a* cushion part
12*b*, 12*c* flange
13 dumper
15 fixing part
100 loudspeaker

DETAILED DESCRIPTION OF THE INVENTION

Embodiments of the present invention address the difficulty in suppressing fluctuation of the resonance level at a natural vibration frequency in a conventional diaphragm. For example, in an oval diaphragm, when a plurality of center lines are drawn from an outer periphery to a center point, each center line has a constant distance at the same angle position in right and left directions with respect to the center point. This is the reason that the resonance level can not be reduced as expected.

Embodiments of the present invention are directed to the shape of a diaphragm's outer periphery. The shape of the outer periphery of this diaphragm is formed as follows: A first circle and a second circle overlap each other with their center points displaced in such a manner that at least one part of an outer periphery of the first circle and the second circle forms a part of the substantially circular outer periphery of the entire shape of the diaphragm. Using this shape, most center lines drawn from an edge of the outer periphery to the center point have different distances on a right side and a left side from the center point of the diaphragm. This can reduce the resonance level considerably. As a result, signal reproduction characteristics can be flattened significantly.

Exemplary embodiments of the present invention are demonstrated hereinafter with reference to the accompanying drawings.

FIG. 1 is a sectional view of loudspeaker 100 in accordance with the exemplary embodiment of the present invention. Loudspeaker 100 shown in FIG. 1 accommodates magnetic circuit 2 at an inner bottom surface of dish-shaped frame 1. Magnetic circuit 2 includes magnet 3, yoke 4 and plate 5. Magnetic gap 6 is formed between yoke 4 and a tip of plate 5.

Coil part 8 which is a lower end part of cylindrical voice coil 7 is movably accommodated in magnetic gap 6. In addition, an upper end of voice coil 7 penetrates through-hole 10 of a center of diaphragm 9 and projects upward. Voice coil 7 and diaphragm 9 are fixed at the penetrating position by using an adhesive. Moreover, cap 11 covers an upper end of voice coil 7.

Figure 2:
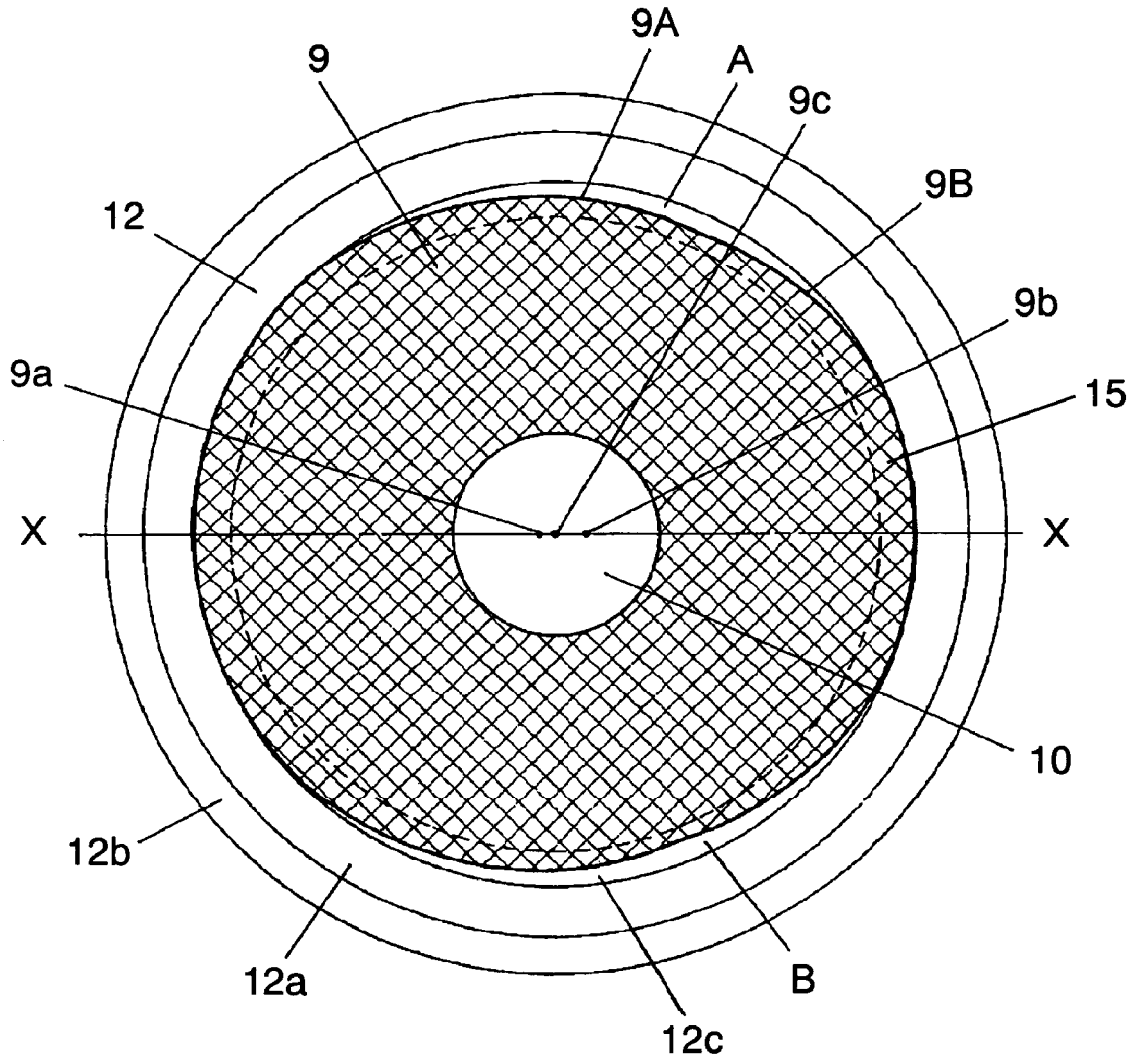
FIG. 2 is a plan view of a diaphragm in accordance with the exemplary embodiment of the present invention.

As shown in FIGS. 1 and 2, diaphragm 9 has through-hole 10 for fixing voice coil 7 at its center part, and has fixing part 15 of edge 12 at its outer periphery whose shape is substantially circular. The shape of the outer periphery of diaphragm 9 is formed as follows: First circle 9A and second circle 9B overlap each other with their center points 9*a* and 9*b* are displaced in such a manner that at least one part of an outer periphery of the first circle and the second circle forms a part of the substantially circular outer periphery of the entire shape.

Figure 3:
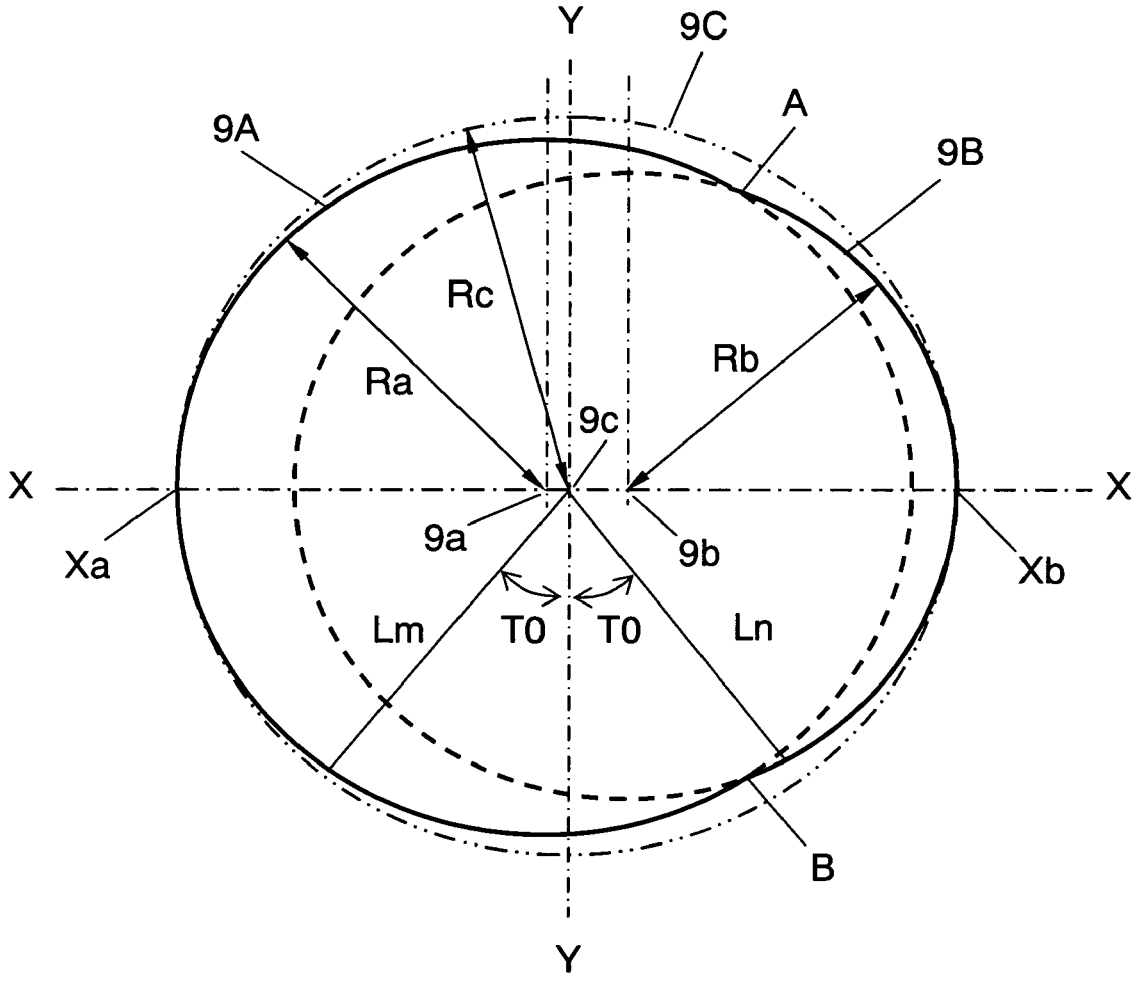
FIG. 3 is a plan view showing a shape of the diaphragm in accordance with the exemplary embodiment of the present invention.
Figure 4:
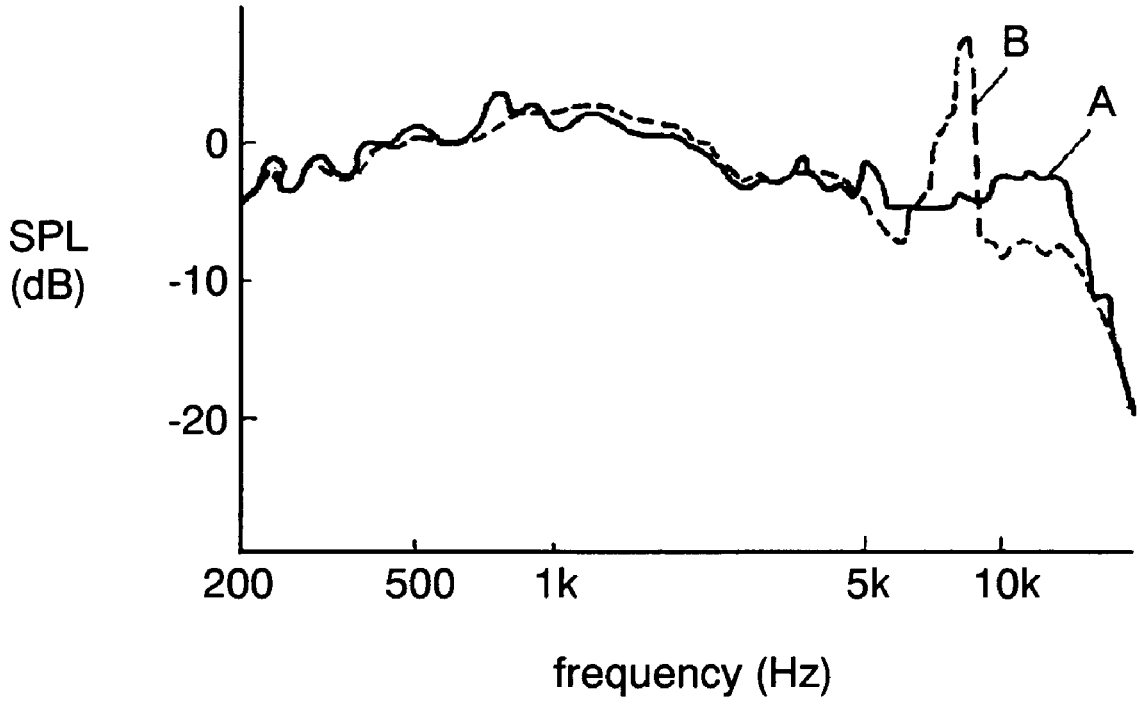
FIG. 4 is a signal reproduction characteristic in accordance with the exemplary embodiment of the present invention.

Using FIG. 3, which illustrates a schematic top view of diaphragm 9, the shape of the diaphragm is described hereinafter in more detail. First circle 9A has radius Ra and center point 9*a*. Second circle 9B has radius Rb and center point 9*b*. Third circle 9C has radius Rc and center point 9*c*, and surrounds first circle 9A and second circle 9B. Further, third circle 9C contacts an outer periphery of first circle 9A at point Xa on line X-X, and contacts an outer periphery of second circle 9B at point Xb on line X-X. The outer periphery of first circle 9A and the outer periphery of second circle 9B cross each other at point A and point B. A solid line denotes the outer periphery of diaphragm 9. The outer periphery of small circle 9B whose radius is Rb is shown from point A to point B in clockwise direction, and the outer periphery of large circle 9A whose radius is Ra is shown from point B to point A in clockwise direction. Most center lines drawn from the outer periphery of the diaphragm 9 to center point 9*c* of third circle 9C have different distances on the right side and the left side of center point 9*c*. For example, distance Lm, which is defined as a distance from center point 9*c* to the outer periphery of first circle 9A at angle TO with respect to line Y-Y in a left direction, differs from distance Ln, which is defined as a distance from center point 9*c* to the outer periphery of second circle 9B at angle TO with respect to line Y-Y in a right direction. However, distances on the right side and the left side are the same only at center line X-X. This structure significantly reduces the resonance level. As a result, as shown in FIG. 4, the signal reproduction characteristics are flattened (line A) as compared with a conventional diaphragm, shown as line B. Particularly, the frequency characteristic at near 10 kHz is considerably flattened as compared with a conventional diaphragm. In FIG. 4, SPL stands for "output sound pressure level" and is shown as a value of dB.

As shown in FIG. 1, cushion part 12*a*, which protrudes upward and has a semicircular cross section, form a circular shape as shown in FIG. 2. In addition, circular flange 12*b* for fixing to frame 1 is formed at an outer periphery of cushion part 12*a*, and circular flange 12*c* for fixing to diaphragm 9 is formed at an inner periphery of cushion part 12*a*.

An end of an inner periphery of ring-shaped dumper 13 is fixed to a lower surface of diaphragm 9, and an end of an outer periphery of dumper 13 is fixed to frame 1 via edge 14.

INDUSTRIAL APPLICABILITY

According to a diaphragm of the present invention, signal reproduction characteristics can be flattened as compared with a conventional diaphragm, so that appropriate signal reproduction can be performed in a loudspeaker.

The invention claimed is:

1. A conical type diaphragm for a loudspeaker comprising:

an outer peripheral shape defined by a first circle overlapping a second circle, wherein the first circle has a first center point and a first radius, and the second circle has a second center point different from the first center point and a second radius different from the first radius, wherein the outer peripheral shape of the diaphragm is substantially circular, and the first circle and the second circle overlap each other with their center points positioned such that at least one part of an outer periphery of the first circle and at least one part of an outer periphery of the second circle form a part of the substantially circular outer peripheral shape.

2. The conical type diaphragm for the loudspeaker of claim 1, wherein a through-hole for fixing a voice coil is formed at a center of the diaphragm, and the diaphragm has an edge-fixing part configured to fix the diaphragm to a loudspeaker frame via an edge at an outer periphery of the diaphragm.

3. A conical type diaphragm for the loudspeaker of claim 1, wherein a through-hole for fixing a voice coil is formed at a center of the diaphragm; and an edge-fixing part is disposed at an outer periphery of the diaphragm.

4. The conical type diaphragm of claim 3, wherein center points of the first circle and the second circle are displaced from a center point of an overall shape of the diaphragm.

5. The conical type diaphragm for the loudspeaker of claim 1, wherein the diaphragm has a third circle, the third circle surrounds both the first circle and the second circle, and the third circle contacts with outer peripheries of the first circle and the second circle, and a center point of the third circle is a center point of the diaphragm.

6. A loudspeaker comprising:

a magnetic circuit including a magnetic gap;

a cylindrical voice coil having a first end and a second end, the first end configured to be inserted into the magnetic gap;

a conical type diaphragm fixed to the second end of the voice coil; and a frame holding an outer periphery of the diaphragm via an edge, wherein a through-hole for fixing the voice coil is formed at a center of the diaphragm, wherein the diaphragm has an outer peripheral shape defined by a first circle overlapping a second circle, wherein the first circle has a first center point and a first radius, and the second circle has a second center point different from the first center point and a second radius different from the first radius, and wherein the first circle and the second circle overlap each other with their center points positioned such that at least one part of an outer periphery of the first circle and at least one part of an outer periphery of the second circle form a part of the substantially circular outer peripheral shape.

7. The loudspeaker of claim 6, wherein the diaphragm has a third circle, the third circle surrounds both the first circle and the second circle, and the third circle contacts with outer peripheries of the first circle and the second circle, and a center point of the third circle is a center point of the diaphragm.

8. The loudspeaker of claim 6, wherein center points of the first circle and the second circle are positioned from a center point of an overall shape of the diaphragm.

9. A loudspeaker comprising:

a magnetic circuit including a magnetic gap;

a cylindrical voice coil having a first end and a second end, the first end being configured to be inserted into the magnetic gap;

a conical type diaphragm fixed to the second end of the voice coil; and a frame holding an outer periphery of the diaphragm via an edge, wherein a through-hole for fixing the voice coil is formed at a center of the diaphragm, wherein the diaphragm has an outer peripheral shape defined by a first circle overlapping a second circle, and wherein the first circle has a first center point and a first radius, and the second circle has a second center point different from the first center point and a second radius different from the first radius, and the first circle and the second circle overlap each other with their center points positioned such that at least one part of an outer periphery of the first circle and at least one part of an outer periphery of the second circle form a part of the substantially circular outer peripheral shape;

wherein the diaphragm has a third circle, the third circle surrounds both the first circle and the second circle, and the third circle contacts with outer peripheries of the first circle and the second circle, and a center point of the third circle is a center point of the diaphragm.

* * * * *

UNITED STATES PATENT AND TRADEMARK OFFICE

CERTIFICATE OF CORRECTION

PATENT NO. : 7,627,133 B2
APPLICATION NO. : 10/585848
DATED : December 1, 2009
INVENTOR(S) : Osamu Funahashi It is certified that error appears in the above-identified patent and that said Letters Patent is hereby corrected as shown below:

In Section (56) References Cited, under the "FOREIGN PATENT DOCUMENTS" heading, "JP 2004-04832" should read --JP 2004-048432--.

Signed and Sealed this

Twenty-third Day of March, 2010

David J. Kappos

David J. Kappos
*Director of the United States Patent and Trademark Office*